US009416961B2

(12) United States Patent
Shimada

(10) Patent No.: US 9,416,961 B2
(45) Date of Patent: Aug. 16, 2016

(54) BOILER CONNECTION SYSTEM

(71) Applicant: Rinnai Corporation, Nagoya-shi, Aichi (JP)

(72) Inventor: Shigeki Shimada, Nagoya (JP)

(73) Assignee: Rinnai Corporation, Nagoya-Shi, Aichi (JP)

( * ) Notice: Subject to any disclaimer, the term of this patent is extended or adjusted under 35 U.S.C. 154(b) by 0 days.

(21) Appl. No.: 14/972,571

(22) Filed: Dec. 17, 2015

(65) Prior Publication Data

US 2016/0186988 A1 Jun. 30, 2016

(30) Foreign Application Priority Data

Dec. 26, 2014 (JP) ..... 2014-264912

(51) Int. Cl.
*F22D 5/36* (2006.01)
*F22B 37/20* (2006.01)

(52) U.S. Cl.
CPC ..... *F22B 37/20* (2013.01)

(58) Field of Classification Search
CPC ..... F22B 35/008; F22B 35/18; F22B 35/007; Y02B 30/108
USPC ..... 122/448.3; 237/8 A, 8 B, 8 C, 62, 66; 236/20 R
See application file for complete search history.

(56) References Cited

U.S. PATENT DOCUMENTS 2,780,206 A * 2/1957 La Rocque ..... F22B 31/04 122/448.3
4,864,972 A * 9/1989 Batey ..... F22B 35/008 122/448.3
2002/0026904 A1* 3/2002 Maruyama ..... F24D 3/02 122/414
2013/0099014 A1* 4/2013 Kovalcik ..... G05D 23/1919 237/8 A

FOREIGN PATENT DOCUMENTS

| | | |
|---|---|---|
| JP | H02-057859 | 2/1990 |
| JP | H11-014004 | 1/1999 |
| JP | 2005-061666 | 3/2005 |

OTHER PUBLICATIONS

English Abstract of Japanese Patent Application No. JP2005-061666.
Machine Translation prepared by the Japanese Patent Office of Japanese Patent Application No. JP2005-061666.
English Abstract of Japanese Patent Application No. JPH02-057859.
English Abstract of Japanese Patent Application No. JPH11-014004.
Machine Translation prepared by the Japanese Patent Office of Japanese Patent Application No. JPH11-014004.

* cited by examiner

*Primary Examiner* — Gregory A Wilson
(74) *Attorney, Agent, or Firm* — Vierra Magen Marcus LLP

(57) ABSTRACT

A boiler connection system includes: a plurality of heat source device; and a controller. Each of the plurality of heat source devices includes: a first heat exchanger; a heat medium heating circuit branching at one end thereof from a heat medium return pipe and connected at another end thereof to a heat medium outgoing pipe via the first heat exchanger; a bypass pipe connected to the heat medium heating circuit so as to bypass the first heat exchanger; a pressure-feed device provided on the heat medium heating circuit; a flow passage switching valve; a second heat exchanger provided on the bypass pipe; and a water heating circuit branching at one end thereof from the water supply pipe and connected at another end thereof to a hot water supply pipe via the second heat exchanger.

3 Claims, 3 Drawing Sheets

BOILER CONNECTION SYSTEM

CROSS-REFERENCE TO RELATED APPLICATION(S)

This application claims priority to Japanese Patent Application No. 2014-264912 filed on Dec. 26, 2014, the contents of which are hereby incorporated by reference into the present application.

TECHNICAL FIELD

The present application relates to a boiler connection system which performs hot water supply and/or space heating with a heat medium heated by a plurality of heat sources.

DESCRIPTION OF RELATED ART

A hot water supply system is known which heats water with a plurality of heat source devices by means of combustion heat of burners and supplies the heated water. For example, JP2005-61666A discloses a parallel installation type hot water supply system including a plurality of water heaters.

JP2005-61666A merely describes a technique in which, in the parallel installation type hot water supply system including the plurality of water heaters, the use frequencies of the plurality of water heaters are made uniform. An object of the present application is to provide a boiler connection system which is able to supply water for hot water supply and to supply a heat medium for space heating.

BRIEF SUMMARY OF INVENTION

A boiler connection system disclosed in the present application includes: a heat medium circulating passage including a heat medium outgoing pipe and a heal medium return pipe; a water flow passage including a water supply pipe and a hot water supply pipe; a plurality of heat source devices connected in parallel to the heat medium circulating passage and the water flow passage; and a controller. Each of the plurality of heat source devices includes: a first heat exchanger configured to heat a heat medium by means of combustion heat of a burner; a heat medium heating circuit branching at one end thereof from the heat medium return pipe and connected at another end thereof to the heat medium outgoing pipe via the first heat exchanger; a bypass pipe connected to the heat medium heating circuit so as to bypass the first heat exchanger; a pressure-feed device provided on the heat medium heating circuit and at the first heat exchanger side with respect to a connection portion between the bypass pipe and the heat medium heating circuit; a flow passage switching valve provided at at least one side of the connection portion; a second heat exchanger provided on the bypass pipe and configured to exchange heat with the heat medium flowing through the bypass pipe to heat water supplied from the water supply pipe; and a water heating circuit branching at one end thereof from the water supply pipe and connected at another end thereof to the hot water supply pipe via the second heat exchanger. The controller executes, in each of the plurality of heat source devices: a space heating operation in which the flow passage switching valve is controlled such that a connection destination of a flow passage for the heat medium having passed through the first heat exchanger is the heat medium outgoing pipe, the pressure-feed device is operated, and the heat medium is heated by the first heat exchanger and supplied to the heat medium outgoing pipe; and a hot water supply operation in which the flow passage switching valve is controlled such that the connection destination of the flow passage for the heat medium having passed through the first heat exchanger is the bypass pipe, the pressure-feed device is operated, and the heat medium is heated by the first heat exchanger and supplied to the bypass pipe.

DETAILED DESCRIPTION OF INVENTION

Figure 1:
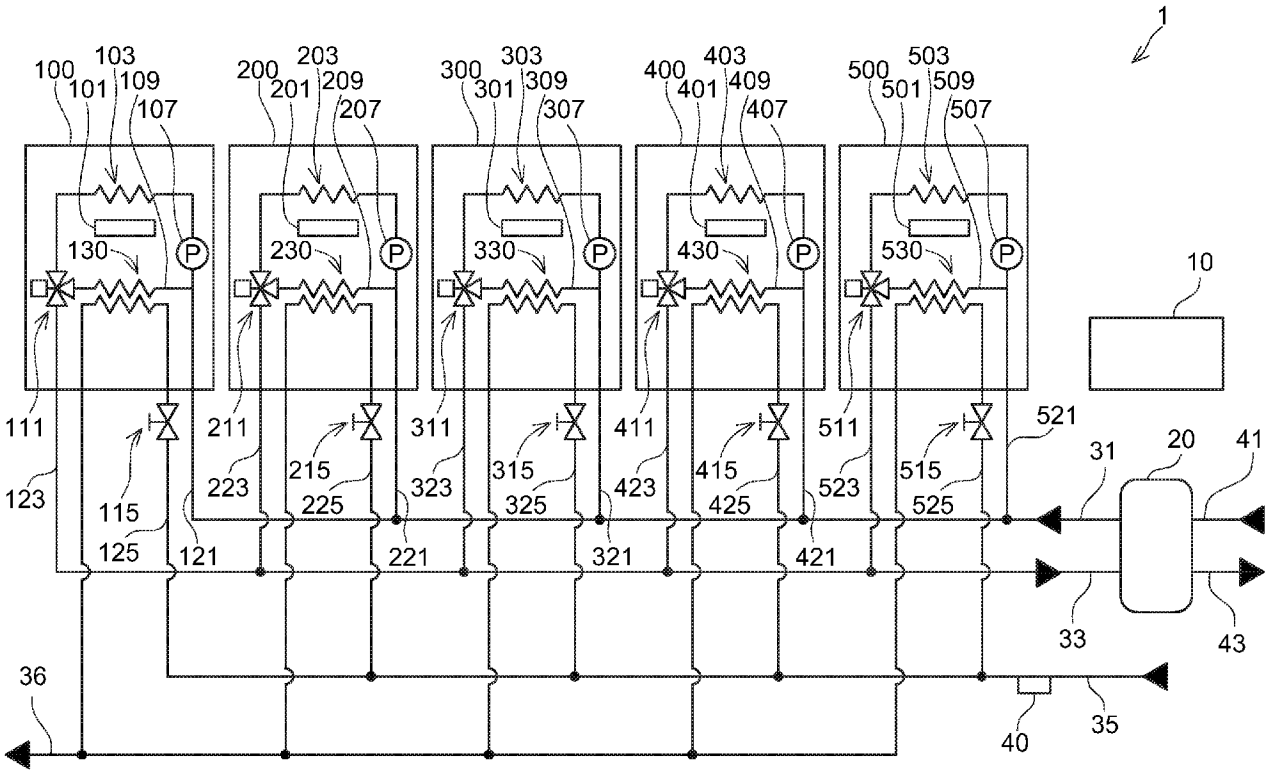
FIG. 1 is a configuration diagram of a boiler connection system according to an embodiment.

In one or more embodiments, the boiler connection system includes, in each heat source device, the first heat exchanger which heats the heat medium, the heat medium heating circuit, the bypass pipe, the pressure-feed device, the flow passage switching valve, the second heat exchanger which heats the water, and the water heating circuit. The bypass pipe is connected to the heat medium heating circuit so as to bypass the first heat exchanger. The flow passage switching valve is provided at at least one side of the connection portion at which the heat medium heating circuit is connected to the bypass pipe. In the heat source device, when the controller controls the flow passage switching valve such that the connection destination of the flow passage for the heat medium having passed through the first heat exchanger is the heat medium outgoing pipe, the heat medium flows and circulates from the heat medium return pipe through the heat medium heating circuit including the first heat exchanger to the heat medium outgoing pipe. In a state where the flow passage is switched as described above, if the controller operates the pressure-feed device, the heat medium flowing from the heat medium return pipe into the heat source device can be heated by the first heat exchanger and returned to the heat medium outgoing pipe, whereby the space heating operation can be performed. In addition, in the heat source device, when the controller controls the flow passage switching valve such that the connection destination of the flow passage for the heat medium having passed through the first heat exchanger is the bypass pipe, the heat medium circulates through the first heat exchanger, the heat medium heating circuit, and the second heat exchanger provided on the bypass pipe. In a state where the flow passage is switched as described above, if the controller heats the heat medium with the first heat exchanger and operates the pressure-feed device, the water flowing from the water supply pipe into the heat source device can be heated and returned to the hot water supply pipe, whereby the hot water supply operation can be performed. The controller can perform the space heating operation by controlling the flow passage switching valve in at least one of the plurality of heat source devices such that flow of the heat medium to the bypass pipe is blocked and the heat medium flows between the heat medium heating circuit and the heat medium circulating passage. In addition, the controller can perform the hot water supply operation by controlling the flow passage switching valve in at least one of the plurality of heat source devices such that flow of the heat medium between the heat medium heating circuit and the heat medium circulating passage is blocked and the heat medium flows to the bypass pipe.

In one or more embodiments of the boiler connection system, the controller may determine whether to perform or stop the space heating operation or the hot water supply operation of each of the plurality of heat source devices, on the basis of an amount of heat required for hot water supply and/or space heating. In this case, in the heat source device whose space heating operation has been determined to be performed, the controller may control the flow passage switching valve such that flow of the heat medium to the bypass pipe is blocked and the heat medium flows between the heat medium heating circuit and the heat medium circulating passage, and operates the pressure-feed device; and in the heat source device whose space heating operation has been determined to be stopped, the controller may control the flow passage switching valve such that flow of the heat medium between the heat medium heating circuit and the heat medium circulating passage is blocked and the heat medium flows to the bypass pipe, and stops the pressure-feed device. According to this, only by controlling the flow passage switching valve which switches between the space heating operation and the hot water supply operation, it is possible to prevent the heat medium from flowing from the heat medium circulating passage into the first heat exchanger of the heat source device determined to be stopped. As a result, in the heat source device which does not need to heat the heat medium, a load is not applied to the pipe in the first heat exchanger, so that it is possible to suppress deterioration of the pipe. That is, it is not necessary to newly provide an open/close valve or the like in order to prevent the heat medium from flowing into the first heat exchanger of the heat source device determined to be stopped.

In one or more embodiments, the boiler connection system may further include: an open/close valve provided on the water heating circuit of each of the plurality of heat source devices; and a flow sensor capable of detecting a flow rate of water flowing through the water flow passage. In this case, the controller may perform control such that, in at least one of the heat source devices whose space heating operation has been determined to be stopped, the open/close valve is opened; and when the flow sensor detects flow of the water through the water flow passage, the controller may execute the hot water supply operation in the heat source device whose space heating operation has been determined to be stopped and whose open/close valve has been opened. According to this, when the flow sensor detects flow of the water through the water flow passage, all the heating capacities of the heat source devices whose space heating operation has been stopped can be used for heating the water, so that it is possible to quickly perform hot water supply.

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved boiler connection systems, as well as methods for using and manufacturing the same.

Moreover, combinations of features and steps disclosed in the following detailed description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Embodiment

As shown in FIG. 1, a boiler connection system 1 according to an embodiment includes a heat medium return pipe 31, a heat medium outgoing pipe 33, a water supply pipe 35, a hot water supply pipe 36, five heat source devices 100, 200, 300, 400, and 500, a water mixer 20, and a controller 10. The heat source devices 100, 200, 300, 400, and 500 are connected in parallel between a heat medium circulating passage (31, 33) and a water flow passage (35, 36). On the water supply pipe 35, a flow sensor 40 which is capable of detecting the flow rate of water flowing through the water supply pipe 35 is provided.

The heat source device 100 includes: a burner 101; a first heat exchanger 103 which heats a heat medium by means of combustion heat of the burner 101; a heat medium return branch pipe 121 which is connected to a fluid inlet of the first heat exchanger 103 and the heat medium return pipe 31; a heat medium supply branch pipe 123 which is connected to a fluid outlet of the first heat exchanger 103 and the heat medium outgoing pipe 33; and a pump 107 (an example of a pressure-feed device) which is provided on the heat medium return branch pipe 121. The heat medium return branch pipe 121 and the heat medium supply branch pipe 123 are an example of a heat medium heating circuit. The heat medium return pipe 31 and the heat medium outgoing pipe 33 are an example of the heat medium circulating passage. In the heat medium heating circuit, the heat medium return branch pipe 121 branches from the heat medium return pipe 31 and is connected to the first heat exchanger 103, and the first heat exchanger 103 is connected to the heat medium outgoing pipe 33 via the heat medium supply branch pipe 123.

The heat source device 100 further includes a bypass pipe 109, a second heat exchanger 130, and a water heating circuit 125. The bypass pipe 109 is connected to the heat medium return branch pipe 121 and the heat medium supply branch pipe 123 so as to bypass the first heat exchanger 103. The second heat exchanger 130 is provided on the bypass pipe 109. The water heating circuit 125 branches at one end thereof from the water supply pipe 35 and is connected at another end thereof to the hot water supply pipe 36 via the second heat exchanger 130. The second heat exchanger 130 exchanges heat with the heat medium flowing through the bypass pipe 109, to heat water supplied from the water supply pipe 35. The pump 107 is provided at the first heat exchanger 103 side with respect to a connection portion between the bypass pipe 109 and the heat medium return branch pipe 121.

The heat source device 100 further includes: an open/close valve 115 which is provided on the water heating circuit 125 and between the water supply pipe 35 and the second heat exchanger 130; and a three-way valve 111 which is provided on the heat medium heating circuit and at a connection portion between the heat medium supply branch pipe 123 and the bypass pipe 109. By switching the three-way valve 111, a destination of the heat medium flowing out from the first heat exchanger 103 can be switched to either the bypass pipe 109 or the heat medium outgoing pipe 33. When the three-way valve 111 is controlled such that the destination of the heat medium flowing out from the first heat exchanger 103 is the heat medium outgoing pipe 33, the heat medium flows from the heat medium return pipe 31 through the heat medium return branch pipe 121 into the first heat exchanger 103. The heat medium flowing out from the first heat exchanger 103 flows through the heat medium supply branch pipe 123 into the heat medium outgoing pipe 33. When the three-way valve 111 is controlled such that the destination of the heat medium flowing out from the first heat exchanger 103 is the bypass pipe 109, the heat medium circulates through the first heat exchanger 103 and the second heat exchanger 130.

The heat medium flows out from the water mixer 20 to the heat medium return pipe 31, and flows from the heat medium return pipe 31 into the heat medium return branch pipe 121. When: the three-way valve 111 is controlled such that the destination of the heat medium flowing out from the first heat exchanger 103 is the heat medium supply branch pipe 123; and the pump 107 is operating, the heat medium flows from the heat medium return branch pipe 121 into the first heat exchanger 103. When the burner 101 is performing combustion, the heat medium is heated at the first heat exchanger 103 and flows out through the heat medium supply branch pipe 123 to the heat medium outgoing pipe 33.

When the open/close valve 115 is opened, water for hot water supply flows from the water supply pipe 35 into the second heat exchanger 130. When: the three-way valve 111 is controlled such that the destination of the heat medium flowing out from the first heat exchanger 103 is the bypass pipe 109; and the pump 107 is operating, the heat medium circulates between the first heat exchanger 103, the three-way valve 111, and the bypass pipe 109. When the burner 101 is performing combustion, the heat medium heated at the first heat exchanger 103 flows into the second heat exchanger 130 provided on the bypass pipe 109. By means of the heat medium flowing through the second heat exchanger 130, the water supplied from the water supply pipe 35 can be heated. The water heated at the second heat exchanger 130 flows out to the hot water supply pipe 36.

Each of the heat source devices 200, 300, 400, and 500 has the same configuration as the heat source device 100. Thus, for each of the configurations of the heat source devices 200, 300, 400, and 500, the reference numeral of 100s for each component of the heat source device 100 is replaced with a reference numeral of 200s, 300s, 400s, or 500s, and the description thereof is omitted.

The heat medium flows out from the water mixer 20 to the heat medium return pipe 31, flows from the heat medium return pipe 31 through the heat medium return branch pipes 121, 221, 321, 421, and 521 into the heat source devices 100, 200, 300, 400, and 500, flows through the first heat exchangers 103, 203, 303, 403, and 503, and flows out through the heat medium supply branch pipes 123, 223, 323, 423, and 523 to the heat medium outgoing pipe 33. When any of the heat source devices 100, 200, 300, 400, and 500 is in a space heating operation state, the temperature of the heat medium flowing from the heat medium outgoing pipe 33 into the water mixer 20 is higher than that of the heat medium flowing out from the water mixer 20 to the heat medium return pipe 31. A heat medium circulating through a heating terminal flows through a heating terminal return pipe 41 into the water mixer 20, passes through the water mixer 20, and flows out through a heating terminal outgoing pipe 43. In the water mixer 20, the heat medium circulating through the heating terminal is heated by the heat medium circulating through the heat source devices 100, 200, 300, 400, and 500.

The controller 10 determines whether to perform or stop a space heating operation or a hot water supply operation of each of the heat source devices 100, 200, 300, 400, and 500, on the basis of an amount of heat required for hot water supply and/or space heating. In the present embodiment, control performed by the controller 10 when the heat source devices 100 and 200 are stopped and the heat source devices 300, 400, and 500 are operated to perform the space heating operation, and control performed by the controller 10 when a demand for hot water supply occurs in this state, will be described.

Figure 2:
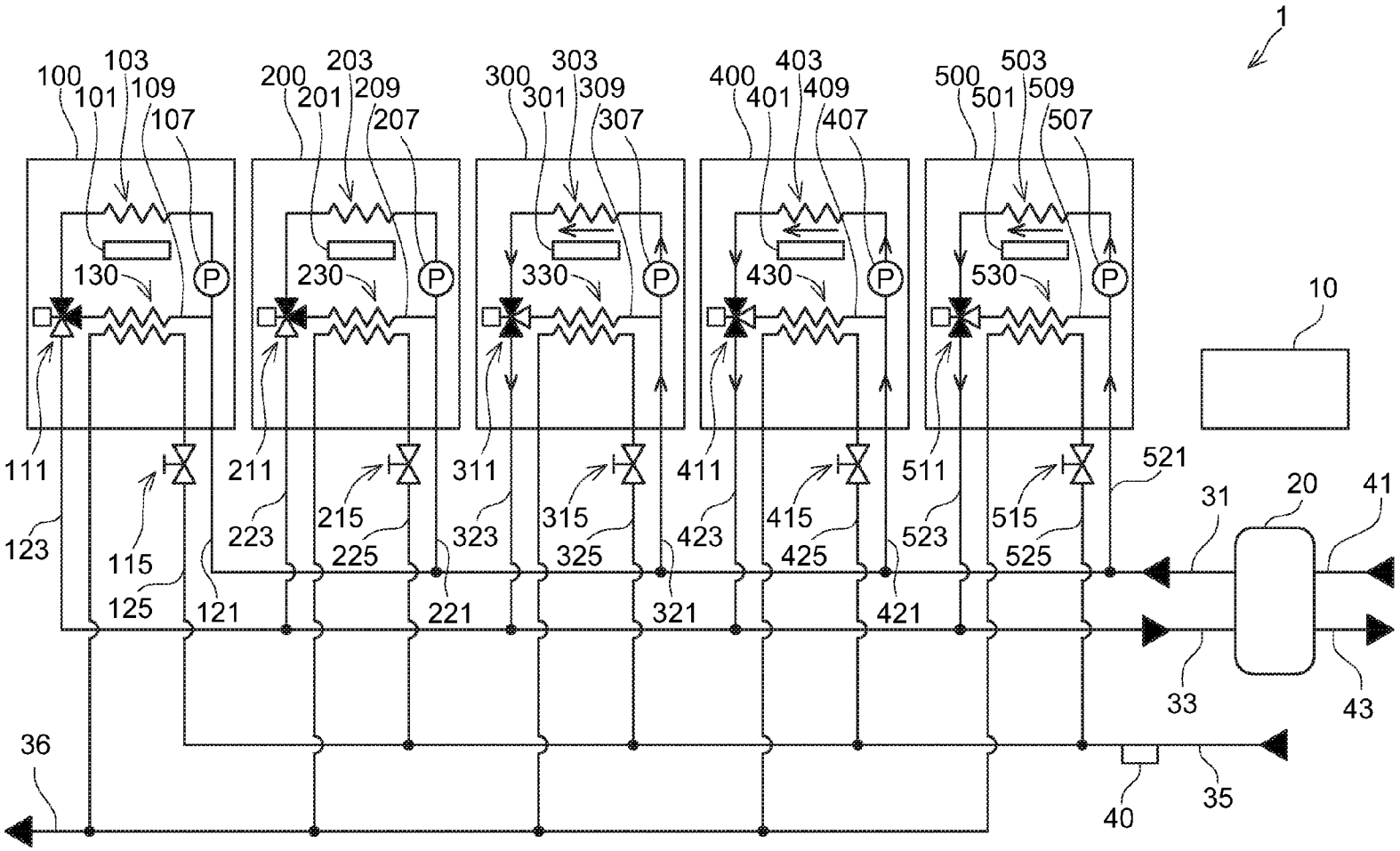
FIG. 2 is a configuration diagram of the boiler connection system according to the embodiment, illustrating an example of control during a space heating operation.

When the controller 10 determines to stop the heat source devices 100 and 200 and to operate the heat source devices 300, 400, and 500 on the basis of an amount of heat required for the space heating operation, the controller 10 controls the three-way valves 311, 411, and 511 of the heat source devices 300, 400, and 500 determined to be operated, to connect the first heat exchangers 303, 403, and 503 of the heat source devices 300, 400, and 500 to the heat medium outgoing pipe 33 via the heat medium supply branch pipes 323, 423, and 523 such that a destination of the heat medium flowing out from each of the first heat exchangers 303, 403, and 503 is the heat medium outgoing pipe 33 as shown in FIG. 2. In addition, the controller 10 operates the pumps 307, 407, and 507 and ignites the burners 301, 401, and 501 to cause the burners 301, 401, and 501 to perform combustion. Accordingly, the heat medium flows from the heat medium return pipe 31 through the heat medium return branch pipes 321, 421, and 521 into the first heat exchangers 303, 403, and 503 and is heated by the burners 301, 401, and 501. The heated heat medium flows out through each of the heat medium supply branch pipes 323, 423, and 523 to the heat medium outgoing pipe 33. The heated heat medium flows from the heat medium outgoing pipe 33 into the water mixer 20 and heats the heat medium circulating through the heating terminal. In addition, the controller 10 controls the open/close valves 315, 415, and 515 such that the open/close valves 315, 415, and 515 are in a closed state.

The controller 10 controls the three-way valves 111 and 211 of the heat source devices 100 and 200 determined to be stopped, such that the destinations of the heat medium flowing out from the first heat exchangers 103 and 203 of the heat source devices 100 and 200 are the bypass pipes 109 and 209. The pumps 107 and 207 are in a stop state, and no heat medium flows out and in between: the heat medium return pipe 31 and the heat medium outgoing pipe 33; and the heat source devices 100 and 200. In addition, no heat medium circulates through the pipes within the heat source devices 100 and 200. Moreover, the controller 10 controls the open/close valves 115 and 215 such that the open/close valves 115 and 215 are in an opened state.

Figure 3:
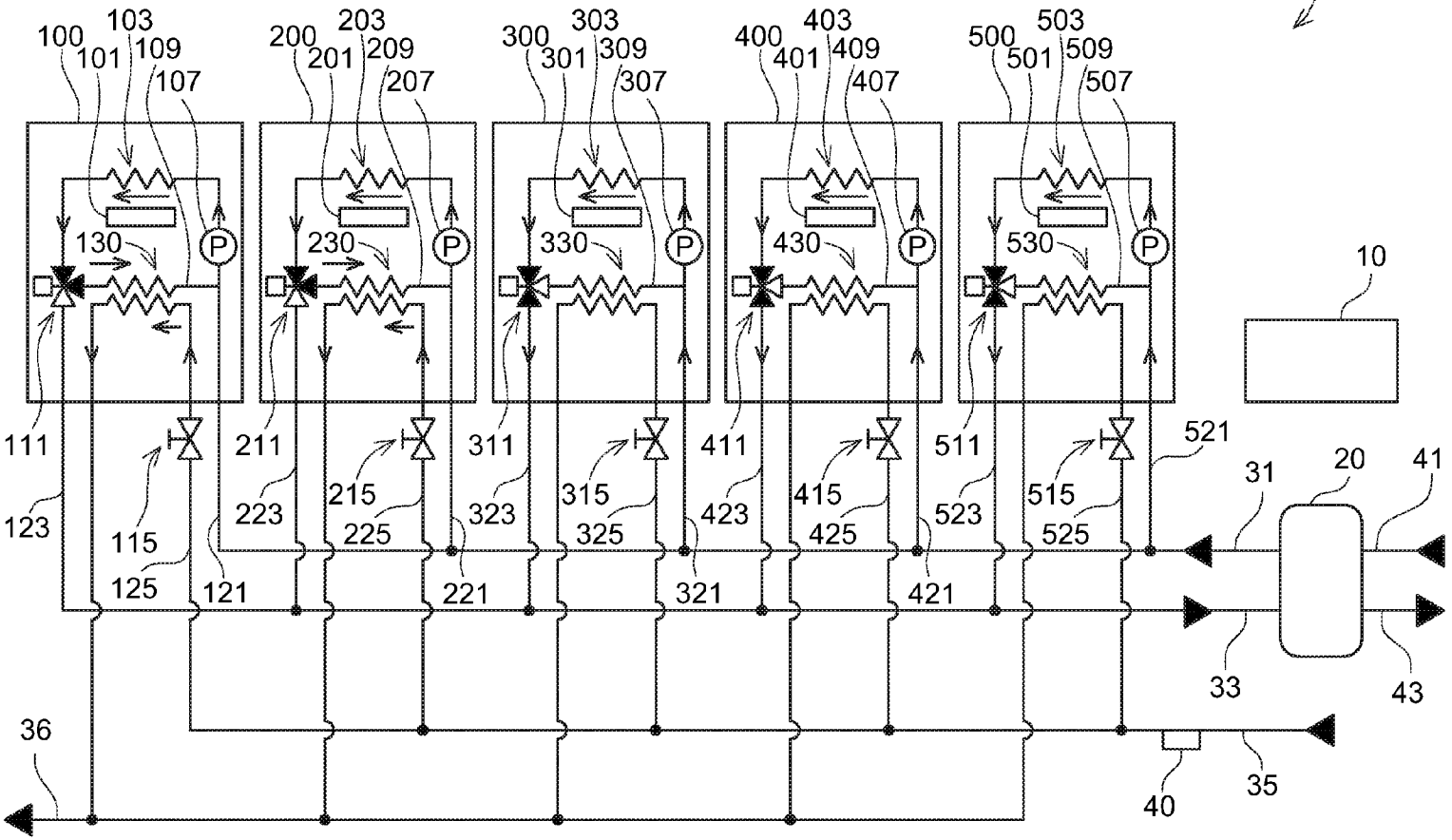
FIG. 3 is a configuration diagram of the boiler connection system according to the embodiment, illustrating an example of control in which a hot water supply operation is performed during the space heating operation.

Next, the control performed by the controller 10 when a demand for hot water supply occurs in this state will be described with reference to FIG. 3. For example, when a faucet is opened, the water for hot water supply flows through the water supply pipe 35 and the hot water supply pipe 36. Since the open/close valves 115 and 215 are in an opened state, the water flowing through the water supply pipe 35 flows through the water heating circuits 125 and 225, on which the open/close valves 115 and 215 are provided, into the second heat exchangers 130 and 230 as shown in FIG. 3. When the flow sensor 40 detects flow of the water through the water supply pipe 35 (e.g., when a detection value indicating a water flow rate equal to or higher than a predetermined value is inputted from the flow sensor 40), the controller 10 operates the pumps 107 and 207 and ignites the burners 101 and 201 to cause the burners 101 and 201 to perform combustion. Accordingly, the heat medium circulates between the first heat exchanger 103, the three-way valve 111, and the bypass pipe 109 in the heat source device 100. The heat medium is heated at the first heat exchanger 103 by means of combustion heat of the burner 101 and flows through the second heat exchanger 130 provided on the bypass pipe 109. By means of the heat medium flowing through the second heat exchanger 130, the water supplied from the water supply pipe 35 is heated. In addition, the heat medium circulates between the first heat exchanger 203, the three-way valve 211, and the bypass pipe 209 in the heat source device 200. The heat medium is heated at the first heat exchanger 203 by means of combustion heat of the burner 201 and flows through the second heat exchanger 230 provided on the bypass pipe 209. By means of the heat medium flowing through the second heat exchanger 230, the water supplied from the water supply pipe 35 is heated. The water heated by the second heat exchangers 130 and 230 flows out through the downstream sides of the water heating circuits 125 and 225 to the hot water supply pipe 36. According to the boiler connection system 1, when a demand for hot water supply occurs during space heating, all the heating capacities of the currently stopped heat source devices 100 and 200 can be used for heating the water, so that it is possible to quickly perform hot water supply.

As described above, the boiler connection system 1 according to the embodiment includes the three-way valve (111, etc.) which is capable of switching the destination of the heat medium flowing out from the first heat exchanger (103, etc.) to either the heat medium outgoing pipe (33) or the bypass pipe (109, etc.). When the three-way valve (111, etc.) is controlled such that the destination of the heat medium flowing out from the first heat exchanger (103, etc.) is the heat medium outgoing pipe (33), the heat medium circulates through the first heat exchanger (103 etc.), the heat medium return pipe 31, and the heat medium outgoing pipe 33. When the three-way valve (111, etc.) is controlled such that the destination of the heat medium flowing out from the first heat exchanger (103, etc.) is the bypass pipe (109, etc.), the heat medium circulates through the first heat exchanger (103, etc.) and the second heat exchanger (130, etc.). The controller 10 controls the three-way valves 111 and 211 such that the destinations of the heat medium flowing out from the first heat exchangers (103, etc.) are the bypass pipes 109 and 209 in the heat source devices 100 and 200 whose space heating operation has been determined to be stopped. Accordingly, in the heat source devices 100 and 200 determined to be stopped, the heat medium circulates through the first heat exchangers 103 and 203 and the second heat exchangers 130 and 230, and flow of the heat medium from the heat medium return branch pipes 121 and 221 to the first heat exchangers 103 and 203 is stopped. According to the above-described boiler connection system 1, only by controlling the three-way valves 111 and 211 which are used in switching between the space heating operation and the hot water supply operation, it is possible to stop flow of the heat medium from the heat medium return pipe 31 into the first heat exchangers 103 and 203 in the heat source devices 100 and 200 determined to be stopped. As a result, in the heat source devices 100 and 200 which do not need to heat the heat medium, a load is not applied to the pipes in the first heat exchangers 103 and 203, so that it is possible to suppress deterioration of the pipes. In the above-described boiler connection system 1, it is not necessary to newly provide an open/close valve in order to prevent the heat medium from flowing into each of the first heat exchangers 103 and 203 of the heat source devices 100 and 200 determined to be stopped.

In the above-described boiler connection system 1, the controller 10 performs control such that: in the heat source devices 300, 400, and 500 determined to be operated, the open/close valves 315, 415, and 515 thereof are closed; and in the heat source devices 100 and 200 determined to be stopped, the open/close valves 115 and 215 thereof are opened. When a demand for hot water supply occurs in this state and the water flows through the water supply pipe 35, while the water flows through the water heating circuits 125 and 225, the water does not flow through the water heating circuits 325, 425, and 525. When the flow sensor 40 detects flow of the water through the water supply pipe 35, the controller 10 performs control to operate the pumps 107 and 207 and to ignite the burners 101 and 201 to cause the burners 101 and 201 to perform combustion, whereby it is possible to quickly perform hot water supply by using the heat source devices 100 and 200.

In the above-described embodiment, the pump (107, etc.) as the pressure-feed device is provided at the first heat exchanger (103, etc.) side with respect to the connection portion between the bypass pipe 109 and the heat medium return branch pipe 121. However, the pressure-feed device may be provided at the first heat exchanger (103, etc.) side with respect to the connection portion between the bypass pipe 109 and the heat medium supply branch pipe 123. In addition, in the above-described embodiment, the three-way valve (111, etc.) is a three-way valve (111, etc.) which is provided at the connection portion between the heat medium supply branch pipe (123, etc.) and the bypass pipe (109, etc.) and is capable of switching the destination of the heat medium flowing out from the first heat exchanger 103 to either the heat medium outgoing pipe (33) or the bypass pipe (109, etc.), but is not limited thereto. The three-way valve may be provided at the connection portion between the heat medium return branch pipe (121, etc.) and the bypass pipe (109, etc.), and the destination of the heat medium flowing out from the first heat exchanger 103 may be switched to either the heat medium outgoing pipe (33, etc.) or the bypass pipe (109, etc.) by the three-way valve (111, etc.). Moreover, in the above-described embodiment, the open/close valve (115, etc.) is provided between the water heating circuit (125, etc.) and the water supply pipe (35), but the position of the open/close valve is not limited thereto. For example, the open/close valve may be provided between the water heating circuit (125, etc.) and the hot water supply pipe (36).

Specific examples of the present invention has been described in detail, however, these are mere exemplary indications and thus do not limit the scope of the claims. The art described in the claims include modifications and variations of the specific examples presented above. Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

What is claimed is:

1. A boiler connection system comprising:

a heat medium circulating passage including a heat medium outgoing pipe and a heat medium return pipe;

a water flow passage including a water supply pipe and a hot water supply pipe;

a plurality of heat source devices connected in parallel to the heat medium circulating passage and the water flow passage; and a controller, wherein each of the plurality of heat source devices includes:

a first heat exchanger configured to heat a heat medium by means of combustion heat of a burner;

a heat medium heating circuit branching at one end thereof from the heat medium return pipe and connected at another end thereof to the heat medium outgoing pipe via the first heat exchanger;

a bypass pipe connected to the heat medium heating circuit so as to bypass the first heat exchanger;

a pressure-feed device provided on the heat medium heating circuit and at the first heat exchanger side with respect to a connection portion between the bypass pipe and the heat medium heating circuit;

a flow passage switching valve provided at at least one side of the connection portion;

a second heat exchanger provided on the bypass pipe and configured to exchange heat with the heat medium flowing through the bypass pipe to heat water supplied from the water supply pipe; and a water heating circuit branching at one end thereof from the water supply pipe and connected at another end thereof to the hot water supply pipe via the second heat exchanger, and the controller executes, in each of the plurality of heat source devices:

a space heating operation in which the flow passage switching valve is controlled such that a connection destination of a flow passage for the heat medium having passed through the first heat exchanger is the heat medium outgoing pipe, the pressure-feed device is operated, and the heat medium is heated by the first heat exchanger and supplied to the heat medium outgoing pipe; and a hot water supply operation in which the flow passage switching valve is controlled such that the connection destination of the flow passage for the heat medium having passed through the first heat exchanger is the bypass pipe, the pressure-feed device is operated, and the heat medium is heated by the first heat exchanger and supplied to the bypass pipe.

2. The boiler connection system according to claim 1, wherein the controller determines whether to perform or stop the space heating operation or the hot water supply operation of each of the plurality of heat source devices, on the basis of an amount of heat required for hot water supply and/or space heating, in the heat source device whose space heating operation has been determined to be performed, the controller controls the flow passage switching valve such that flow of the heat medium to the bypass pipe is blocked and the heat medium flows between the heat medium heating circuit and the heat medium circulating passage, and operates the pressure-feed device, and in the heat source device whose space heating operation has been determined to be stopped, the controller controls the flow passage switching valve such that flow of the heat medium between the heat medium heating circuit and the heat medium circulating passage is blocked and the heat medium flows to the bypass pipe, and stops the pressure-feed device.

3. The boiler connection system according to claim 1, further comprising:

an open/close valve provided on the water heating circuit of each of the plurality of heat source devices; and a flow sensor capable of detecting a flow rate of water flowing through the water flow passage, wherein the controller performs control such that, in at least one of the heat source devices whose space heating operation has been determined to be stopped, the open/close valve is opened, and when the flow sensor detects flow of the water through the water flow passage, the controller executes the hot water supply operation in the heat source device whose space heating operation has been determined to be stopped and whose open/close valve has been opened.

* * * * *